United States Patent [19]

Kojima et al.

[11] 4,133,703

[45] Jan. 9, 1979

[54] PERMANENT MAGNETIC Mn-Al-C ALLOY

[75] Inventors: Shigeru Kojima, Kyoto; Kiyoshi Kojima, Katano; Satoru Mitani, Hirakata, all of Japan

[73] Assignee: Matsushita Electric Industrial Co., Ltd., Japan

[21] Appl. No.: 825,459

[22] Filed: Aug. 17, 1977

[30] Foreign Application Priority Data

Aug. 27, 1976 [JP] Japan ..... 51-102934

[51] Int. Cl.[2] ..... H01F 1/04

[52] U.S. Cl. ..... 148/31.57; 75/134 M; 148/101

[58] Field of Search ..... 75/134 M; 148/101, 31.57

[56] References Cited

U.S. PATENT DOCUMENTS

| | | | |
|---|---|---|---|
| 3,116,181 | 12/1963 | Hokkeling et al. | 148/31.57 |
| 3,194,654 | 7/1965 | Kaneko | 75/134 M |
| 3,730,784 | 5/1973 | Yamamoto | 148/101 |
| 4,042,429 | 8/1977 | Kojima et al. | 75/134 M |

*Primary Examiner*—M. J. Andrews

*Attorney, Agent, or Firm*—Wenderoth, Lind & Ponack

[57] ABSTRACT

A permanent magnetic alloy which is obtained by adding copper in amount of 0.5 to 6.2 wt% to the conventional Mn-Al-C alloy comprising 68.0 to 73.0 wt% of manganese, (1/10 Mn — 6.6) to (1/3 Mn — 22.2) wt% of carbon and the remainder aluminum and subjecting thus prepared alloy to warm plastic deformation in order to improve plasticity of the alloy.

3 Claims, 2 Drawing Figures

PERMANENT MAGNETIC MN-AL-C ALLOY

BACKGROUND OF THE INVENTION

The present invention relates to a permanent magnet, more particularly, to a manganese-aluminum-carbon (Mn-Al-C) alloy magnet containing copper (Cu) in order to improve plasticity thereof.

An alloy comprising manganese, aluminum and carbon in suitable amounts and having been subjected to suitable heat treatment is a known permanent magnet material. Recently, a new alloy magnet comprising 68.0 to 73.0% by weight of manganese, carbon in amounts ranging from (1/10 Mn — 6.6) to (1/3 Mn — 22.2)% (wherein Mn in the formulae represents percent of manganese content) and the remainder aluminum and having been subjected to warm plastic deformation has been disclosed in U.S. Pat. No. 3,976,519. The new magnet, subjected to warm plastic deformation, exhibits excellent magnetic characteristics, e.g. the (BH)max is several times as large as that of the magnet subjected to suitable heat treatment, and is machinable. The permanent magnet subjected to warm plastic deformation is useful for practical purposes and is produced industrially.

However, some difficulties have been encountered in the warm plastic deformation step during industrial manufacture of this magnet, as follows: the Mn-Al-C ternary alloy exhibits plasticity at a temperature of more than 530° C. and can be subjected to warm plastic deformation, for example, extrusion or die-upsetting. But the plasticity of the ternary alloy is not very good, that is to say deformation resistance of the ternary alloy is not very small, and therefore the ternary alloy is subjected to deforming by applying a larger pressure and to deforming under higher temperature, which yields lower deformation resistance. But the application of a large pressure at the deformation step brings about a remarkable shortening of life of a die because of abrasion and creep, and brings about cracks within the deformed alloy magnet. The high deformation temperature also brings about shortening of life of the die because of decrease of the mechanical strength thereof and further induces decrease of the magnetic characteristics of the deformed alloy. Then, the large deformation pressure and the high deformative temperature result in increase of energy cost and manufacturing equipment cost, because a particular die built from a particular material and a complicated structure and press with large pressure capacity are required. These difficulties can be solved, if deformation resistance of the alloy magnet is decreased. For example, the life of a die is almost proportional to the exponent of the decreasing coefficient of the deformation resistance. When using a die composed of a tungsten-cobalt-cromium alloy steel, when the deformation resistance of the Mn-Al-C alloy is decreased by 10%, the life-time of the die is extended approximately ten fold.

In order to solve the above-mentioned difficulties in the industrial production, it has been strongly desired to improve the plasticity of the Mn-Al-C ternary alloy, that is to say, to decrease the deformation resistance of the ternary alloy.

SUMMARY OF INVENTION

An object of the present invention is to provide a permanent magnetic alloy which has excellent plasticity and magnetic characteristics. More specifically, an alloy magnet of the present invention has an alloy composition such as obtained by adding an element of copper in an amount of 0.5 to 6.2% by weight to the conventional Mn-Al-C ternary alloy magnet which consists of 68.0 to 73.0 wt% of manganese, (1/10 Mn — 6.6) to (1/3 Mn — 22.2) wt% of carbon and the remainder aluminum, which has been subjected to warm plastic deformation. The magnetic alloy of the present invention has a small deformation resistance which is improved by 10 to 50% compared with the conventional Mn-Al-C magnetic alloy.

DESCRIPTION OF THE PREFERRED EMBODIMENT

The present invention is further detailed with reference to the following experimental data.

Rod shaped samples (20 mm diameter, 25 mm length) of a Mn-Al-C ternary alloys having an alloy composition within the range of 68.0 to 73.0 wt% of manganese, (1/10 Mn — 6.6) to (1/3 Mn — 22.2) wt% of carbon and the remainder aluminum and an alloy obtained by adding various amounts of copper to the ternary alloy were prepared by melting and casting. These samples were subjected to a heat treatment at a temperature of 1080° C. for one hour and subsequently cooling from that temperature at an average cooling rate of 60° C./minute, and then extruding by using a die with an area reduction of 80% at a temperature of 720° C. At the time of this extrusion, the pressure required to extrude each sample was measured. Magnetic characteristics of the extruded samples were measured along the axial direction of the samples. These extruded samples were magnetically anisotropic permanent magnets having easy direction of magnetization in the axial direction of the samples.

Figure 1:
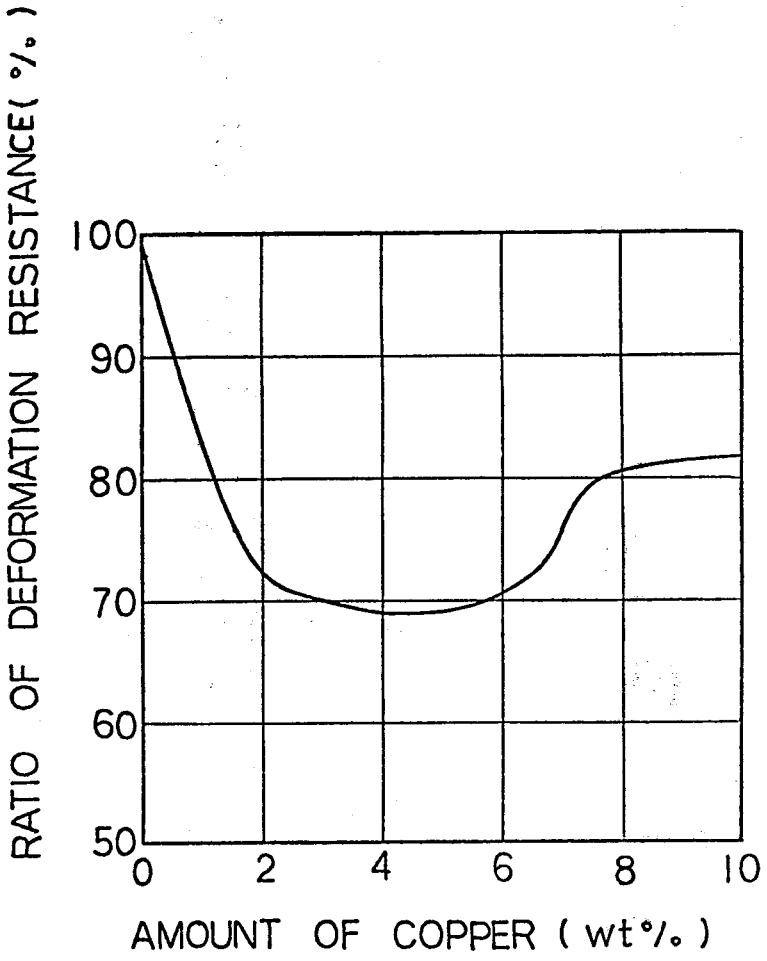
FIG. 1 is a graph depicting the relationship between amount of copper additive and ratios of deformation resistance.

The experimental results are shown in Table 1 and FIG. 1. The deformation resistance in Table 1 were calculated from the values of the pressure measured above. The deformation resistance of the magnet alloy is in proportion to the pressure required to extrude. The ratio in FIG. 1 indicates the ratio of the deformation resistance of the alloy with copper added to that of the alloy not containing copper.

Table 1

| Composition No. | Sample (wt %) Mn | Al | C | Cu | Sample resistance (kg/mm$^2$) | (BH)max (MG·Oe) |
|---|---|---|---|---|---|---|
| 1 | | | | not added | 38.0 | 6.20 |
| 2 | | | | 0.20 | 36.5 | 6.20 |
| 3 | | | | 0.50 | 34.0 | 6.25 |
| 4 | | | | 1.10 | 31.0 | 6.15 |
| 5 | 70.0 | 29.5 | 0.5 | 2.20 | 27.0 | 6.30 |
| 6 | | | | 3.00 | 26.5 | 6.20 |
| 7 | | | | 4.20 | 26.0 | 6.05 |
| 8 | | | | 6.20 | 27.0 | 5.55 |
| 9 | | | | 7.80 | 30.5 | 0.80 |
| 10 | | | | 9.50 | 31.0 | 0.50 |
| 11 | | | | not added | 37.5 | 6.00 |
| | 69.0 | 30.6 | 0.4 | | | |
| 12 | | | | 2.50 | 26.0 | 5.80 |
| 13 | | | | not added | 38.0 | 6.30 |
| 14 | 69.5 | 30.0 | 0.5 | 1.80 | 29.0 | 6.25 |
| 15 | | | | 3.50 | 26.0 | 6.10 |
| 16 | | | | not added | 38.5 | 5.50 |

Table 1-continued

| Composition No. | Sample (wt %) Mn | Al | C | Cu | Sample resistance (kg/mm²) | (BH)max (MG·Oe) |
|---|---|---|---|---|---|---|
| | 70.5 | 28.9 | 0.6 | | | |
| 17 | | | | 2.30 | 27.5 | 5.40 |
| 18 | 71.5 | 27.8 | 0.7 | 2.80 | 26.0 | 5.10 |

As shown in Table 1 in FIG. 1, the deformation resistance of the samples with copper added in an amount of 0.5 wt% or more is 10 to 30% smaller than that of the samples without copper. Then, the samples with copper added in amounts of 6.2% or less have excellent magnetic characteristics of more than 5 MG.Oe. Particularly, in the range of 2.2 to 4.2 wt% of copper, the deformation resistance is about 30% smaller and the magnetic characteristics are about equivalent to that of the samples without copper. Otherwise, in the range of more than 6.2 wt% of copper, the (BH)max decreases remarkably. It is considered that this decrease is caused by the precipitation of non-magnetic phases in the alloy, as a result of X-ray diffraction analysis and microstructure observation.

Machinability of the extruded samples was examined by lathing and drilling. As a result, the samples with copper added in amounts of from 0.5 to 6.2 wt% exhibited better machinability than the samples not containing copper.

The other experiment in which different heat treatment and working methods are applied is described hereinafter.

Rod shaped samples (20 mm diameter, 40 mm length) of an Mn-Al-C alloy consisting of 72.0 wt% of manganese, 27.0 wt% of aluminum and 1.0 wt% of carbon and an alloy obtained by adding copper in an amount of 3.0 wt% to the ternary alloy were prepared by melting and casting. The samples were subjected to heat treatment at a temperature of 1120° C. for one hour, quenched into silicon-oil from that temperature and subsequently annealed at 650° C. for one hour. The samples after heat treatment were magnetically isotropic permanent magnets. The value of (BH)max of the sample without copper was 1.2 MG.Oe and that of the one with copper was 0.8 MG.Oe. Those samples after the heat treatment were subjected to die-upsetting with a length reduction of 50% at 720° C. The pressure required to upset was measured and the deformation resistance was calculated from the pressure. The deformation resistance of the sample without copper was 39.0 kg/mm² and that of the sample with copper added in amount of 3.0 wt% was 26.5 kg/mm². The plasticity was remarkably improved by adding coppper. Both of the upset samples were isotropic permanent magnets and the magnetic characteristics were improved by die-upsetting. The sample without copper and the one with copper exhibited 2.15 Mg.Oe and 2.10 Mg.Oe of (BH)max, respectively. In case of the alloy magnets subjected only to heat treatment, decrease of magnetic characteristics occurs by adding by copper, but in case of the alloy magnets after being subjected to warm plastic deformation, such decrease does not occur.

Then, in another experiment in which the conditions, i.e., alloy composition, heat treament conditions, working methods, working temperatures etc., were varied, it was confirmed that the plasticity of the Mn-Al-C ternary alloy magnet comprised of 68.0 to 73.0 wt% of manganese, (1/10 Mn — 6.6) to (1/3 Mn — 22.2) wt% of carbon and the remainder aluminum was improved remarkably by adding copper in an amount of 0.5 to 6.2 wt%.

Figure 2:
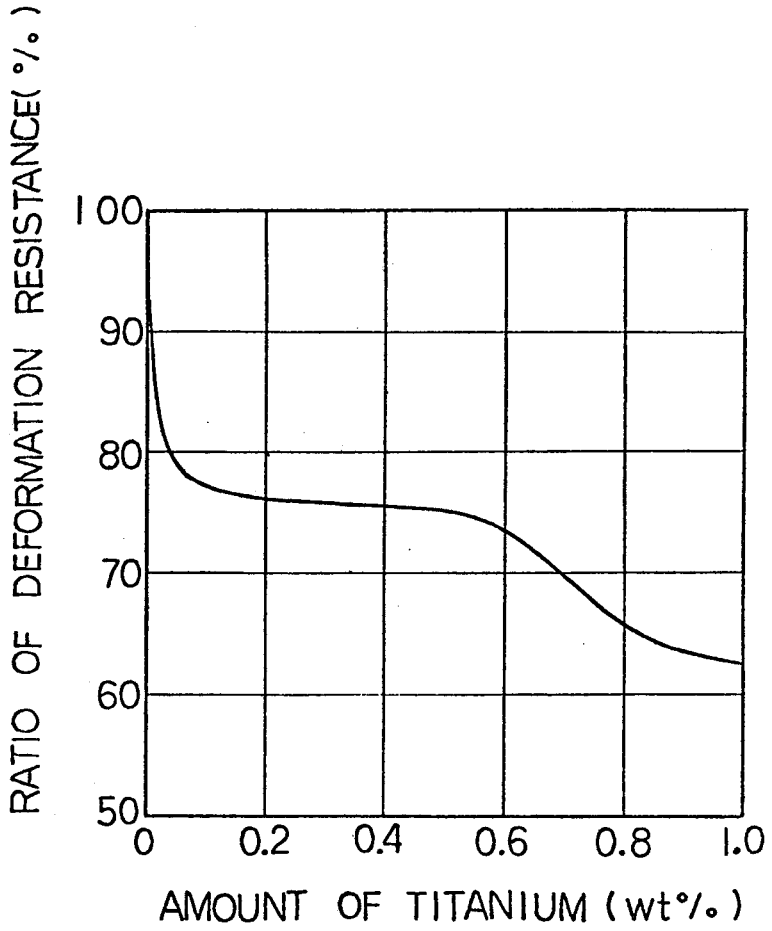
FIG. 2 is a graph depicting the relationship between amount of a further additive of titanium and ratios of deformation resistance.

Moreover, it was confirmed that when titanium in a small amount was further added to the above-mentioned Mn-Al-C-Cu quaternary alloy, the plasticity was still further improved. Results of the experiment which has been performed in the same way as the beforementioned extrusion experiment are set forth in Table 2 and FIG. 2. Each sample shown in Table 2 has an alloy composition obtained by adding copper and titanium to the 70.0 wt% Mn — 29.5 wt% Al — 0.5 wt% C ternary alloy. The ratio in FIG. 2 indicates the ratio of deformation resistance of the Mn-Al-C-Cu quaternary alloy with titanium added to that of the quaternary alloy. When adding titanium in an amount of 0.01 to 0.5 wt%, the deformation resistance is 10 to 25% as small as that of the quaternary alloy. As compared with the Mn-Al-C ternary alloy, the deformation resistance of the alloy added with both copper in an amount of 0.5 to 6.2 wt% and titanium in an amount of 0.01 to 0.5 wt% is improved by 30 to 50%. When titanium is in an amount of more than 0.5 wt%, the (BH)max decreases remarkably because of the transformation from a ferromagnetic phase to non-magnetic phases during extrusion.

Table 2

| Sample No. | Sample amount (wt %) Cu | Ti | Sample resistance (kg/mm²) | (BH)max (MG Oe) |
|---|---|---|---|---|
| 19 | 2.50 | not added | 26.5 | 6.20 |
| 20 | 2.50 | 0.01 | 23.0 | 6.25 |
| 21 | 2.50 | 0.05 | 21.0 | 6.40 |
| 22 | 2.50 | 0.10 | 20.5 | 6.30 |
| 23 | 2.50 | 0.50 | 20.0 | 6.10 |
| 24 | 2.50 | 0.80 | 17.5 | 1.30 |
| 25 | 2.50 | 1.00 | 16.5 | 0.90 |
| 26 | 0.50 | 0.60 | 24.5 | 1.85 |
| 27 | 0.50 | 0.40 | 25.5 | 6.00 |
| 28 | 2.20 | 0.30 | 20.5 | 6.20 |
| 29 | 4.20 | 0.20 | 20.0 | 6.00 |
| 30 | 6.20 | 0.02 | 21.5 | 5.50 |

As clarified by the experiments described above, deformation resistance of the conventional Mn-Al-C ternary alloy magnet is improved remarkably by adding copper in an amount of 0.5 to 6.2 wt%. Particularly, in the range of 2.2 to 4.2 wt% of copper, the deformation resistance decreases to about 30% less than that of the alloy not containing copper. And then, when further adding titanium in an amount of 0.01 to 0.5 wt%, the deformation resistance is improved still further. When applying the deformation step to the magnetic alloy of this invention in the course of manufacture, life of the die is extended more than 10 times. Thus, the alloy magnet of this invention brings about mitigation of the working pressure at the deformation step and solves the previously described difficulties in industrial production.

What is claimed is:

1. In a permanent magnet comprising an Mn-Al-C alloy containing 68.0 to 73.0 wt.% of manganese, (1/10 Mn — 6.6) to (1/3 Mn — 22.2) wt% of carbon and the remainder aluminum, said alloy having been subjected to warm plastic deformation, the improvement wherein said alloy contains copper in an amount of 0.5 to 6.2 wt.% in order to improve the plasticity of said alloy.

2. The permanent magnet according to claim 1 wherein copper is present in an amount between from 2.2 to 4.2 wt.%.

3. The permanent magnet according to claim 1 wherein the alloy further contains titanium in an amount of 0.01 to 0.5 wt% to further improve plasticity.

* * * * *